US006604508B2

(12) United States Patent
Meffert

(10) Patent No.: US 6,604,508 B2
(45) Date of Patent: Aug. 12, 2003

(54) VOLUME REDUCER FOR PRESSURIZING ENGINE HYDRAULIC SYSTEM

(75) Inventor: Darrel H. Meffert, Sparland, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/946,072

(22) Filed: Sep. 4, 2001

(65) Prior Publication Data

US 2003/0041841 A1 Mar. 6, 2003

(51) Int. Cl.[7] ..... F02M 37/04
(52) U.S. Cl. ..... 123/456; 123/179.17
(58) Field of Search ..... 123/179.17, 456, 123/500, 501, 447, 467, 516, 446

(56) References Cited

U.S. PATENT DOCUMENTS

| | | | | |
|---|---|---|---|---|
| 3,815,564 A | * | 6/1974 | Suda et al. | 123/501 |
| 4,526,154 A | * | 7/1985 | DiDomenico | 123/502 |
| 5,213,083 A | | 5/1993 | Glassey | |
| 5,546,912 A | | 8/1996 | Yamada et al. | |
| 5,701,869 A | * | 12/1997 | Richardson et al. | 123/497 |
| 5,787,863 A | | 8/1998 | Henig et al. | |
| 5,839,413 A | * | 11/1998 | Krause et al. | 123/447 |
| 6,092,500 A | * | 7/2000 | Frank et al. | 123/198 D |
| 6,230,684 B1 | * | 5/2001 | Furuhashi et al. | 123/467 |
| 6,234,128 B1 | * | 5/2001 | Reuss | 123/179.17 |
| 2001/0054412 A1 | * | 12/2001 | Kojima | 123/456 |

FOREIGN PATENT DOCUMENTS

| | | |
|---|---|---|
| EP | 1167744 A | 1/2002 |
| EP | 1197649 A | 4/2002 |
| JP | 2001-182639 A | 7/2001 |
| JP | 2002-115619 A | 4/2002 |

* cited by examiner

*Primary Examiner*—Carl S. Miller
(74) *Attorney, Agent, or Firm*—Liell & McNeil

(57) ABSTRACT

A hydraulically activated fuel injection system uses a common rail that is maintained at relatively high pressure by a pump when the engine is running. During start-up, a volume reducer is used to pressurize the common rail until the pump can take over. A member of the volume reducer protrudes through one end of the common rail and is movable into and out of the common rail. When the ignition is activated, the member advances into the common rail causing the fluid volume to decrease and the pressure within the hydraulic system to increase, thereby allowing activation of the fuel injectors and starting the engine before the system pump is able to supply high pressure fluid to the common rail. Once the pump is able to sustain system pressure to the desired level, the member can retract to its original position.

21 Claims, 4 Drawing Sheets

VOLUME REDUCER FOR PRESSURIZING ENGINE HYDRAULIC SYSTEM

TECHNICAL FIELD

This invention relates generally to hydraulic systems for engines, and more particularly to a device and method for pre-pressurizing fluid in a common rail for an engine hydraulic system.

BACKGROUND

An example of a typical hydraulic system for an engine might be a set of hydraulically actuated fuel injectors that utilize engine lubricating oil as their actuation fluid medium. It has long been known that engine lubricating oil expands and contracts as much as 15% or more in volume over the expected temperature range that the engine will encounter. For instance, an engine can fall to relatively low temperatures, possibly below 0° F., when not running in a low temperature environment and can experience substantially higher temperatures when running for a prolonged period in a relatively warm ambient environment. When an engine is running and for some duration after being shut down, the hydraulic systems for the engine will be substantially completely full of lubricating oil. However, as the engine cools, the lubricating oil in the hydraulic system tends to contract and create fluid voids in such areas as the common rail and/or pump priming reservoir of the hydraulic system. While the formation of these fluid voids is expected and not harmful to the engine or hydraulic system, some undesirable results can occur. For instance, when the engine is restarted after a substantial cooling period, a sometimes annoying excessive cranking of the engine is required in order to bring the hydraulic system back up to full pressure to start the engine anew. While this excessive cranking is not indicative of an actual problem, it can be misperceived as a problem by the engine user.

The prior art has addressed this problem by using priming reservoirs such as that shown in U.S. Pat. No. 5,245,970 issued to Iwaszkiewicz et al. on Sep. 21, 1993. The priming reservoir is positioned above the inlet of the high pressure pump and above the common rail passage so that the fluid in the priming reservoir will flow by gravity and/or suction to keep the common rail passage and high pressure pump inlet passage filled with fluid when the high pressure pump is not operating. While these priming reservoirs can reduce crank time, there is room for improvement. For instance, priming reservoirs may not be suitable in vehicles or work machines where there is insufficient space for the priming reservoir above the pump mounting location or the common rail. Further, during startup the high pressure pump must pressurize the entire system before the engine can start.

The present invention is directed to overcoming one or more of the problems set forth above.

SUMMARY OF THE INVENTION

In one aspect of the invention, a method of pressurizing a hydraulic system for an engine includes a first step of reducing a fluid volume of the hydraulic system until fluid pressure reaches a predetermined pressure. After the engine is started, pressure in the hydraulic system is sustained at least in part by further reducing the fluid volume of the hydraulic system.

In another aspect, a method of reducing crank time during engine startup for an engine with a hydraulic system includes the step of pressurizing fluid in the hydraulic system at least in part by reducing a fluid volume of the hydraulic system.

In still another aspect, a hydraulic system for an engine includes a common rail with an inlet and at least one outlet. The inlet of the common rail is fluidly connected to the outlet of a pump. The outlet of the common rail is fluidly connected to the inlet of at least one hydraulic device. A volume reducer includes a member that moves into and out of the common rail.

DETAILED DESCRIPTION

Figure 1:
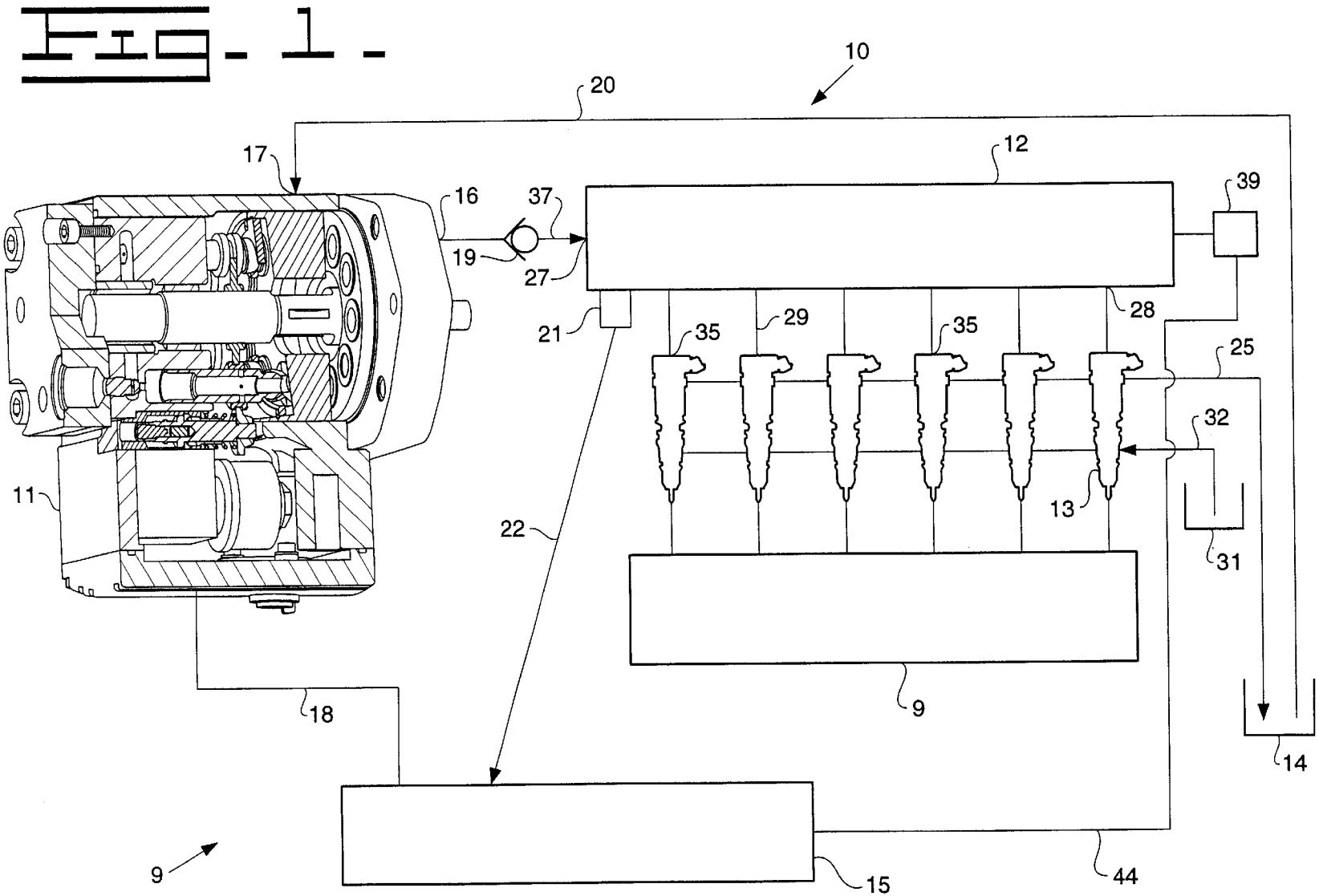
FIG. 1 is a schematic illustration of an engine and an electronically controlled hydraulically actuated fuel injection system according to the present invention.

Referring to FIG. 1, a fuel injected engine 9, preferably a diesel engine, includes a hydraulic system 10, which in the illustrated example is a hydraulically actuated fuel injection system that uses engine lubricating oil as its hydraulic medium. Although the hydraulic system illustrated in FIG. 1 is a fuel injection system using oil as its hydraulic medium, those skilled in the art will appreciate that other hydraulic systems are contemplated, including but not limited to intake and/or exhaust valve actuators, engine brake actuators, etc. Moreover, it should be appreciated by those skilled in the art that other fluid sources having an amount of available fluid, such as coolant, brake fluid, transmission fluid or fuel, could instead be used. In the illustrated example, the hydraulic system 10 has a low pressure reservoir 14 (e.g., oil pan) that serves as a source of lubricating oil, and a pump 11 that is fluidly connected to the low pressure reservoir 14 via a low pressure supply line 20. Pump 11 is preferably a variable delivery pump whose output is controlled by an electronic control module 15 via a pump communication line 18. Those skilled in the art will appreciate that other pump/controller strategies could be substituted. For instance, a fixed displacement pump and a rail pressure control valve that allows fluid to leak from a common rail 12 to the low pressure reservoir 14 when needed could be utilized in the present invention. When the electronic control module 15 activates the pump 11, fluid is delivered from the low pressure reservoir 14 to an inlet 17 of pump 11 via the low pressure supply line 20. After the pump 11 pressurizes the fluid, the fluid is delivered from an outlet 16 of pump 11 to an inlet 27 of the common rail 12 via a high pressure supply line 37. A check valve 19 prevents reverse flow from rail 12 to pump 11. The common rail 12 has a plurality of outlets 28 that are fluidly connected to device inlets 35 of a plurality of fuel injectors 13 via a plurality of device supply lines 29. The fuel injectors 13 use pressurized fluid from the common rail 12 to hydraulically pressurize the fuel that is delivered from a fuel tank 31 to the fuel injectors 13 via a fuel supply line 32. After the actuation fluid has performed its function within the fuel injectors 13, it is channeled back to the low pressure reservoir 14 via an oil return line 25 for recirculation. While six fuel injectors 13 are shown in FIG. 1, the engine 9 may include a different number of fuel injectors 13. Further, one or more additional common rails 12 may be provided wherein each common rail 12 supplies fluid to a portion of the total number of fuel injectors 13 of the engine 9, if desired. Preferably, a volume reducer 39 is mounted on one end of the common rail 12 and is in communication with the electronic control module 15 via a communication line 44.

Figure 2:
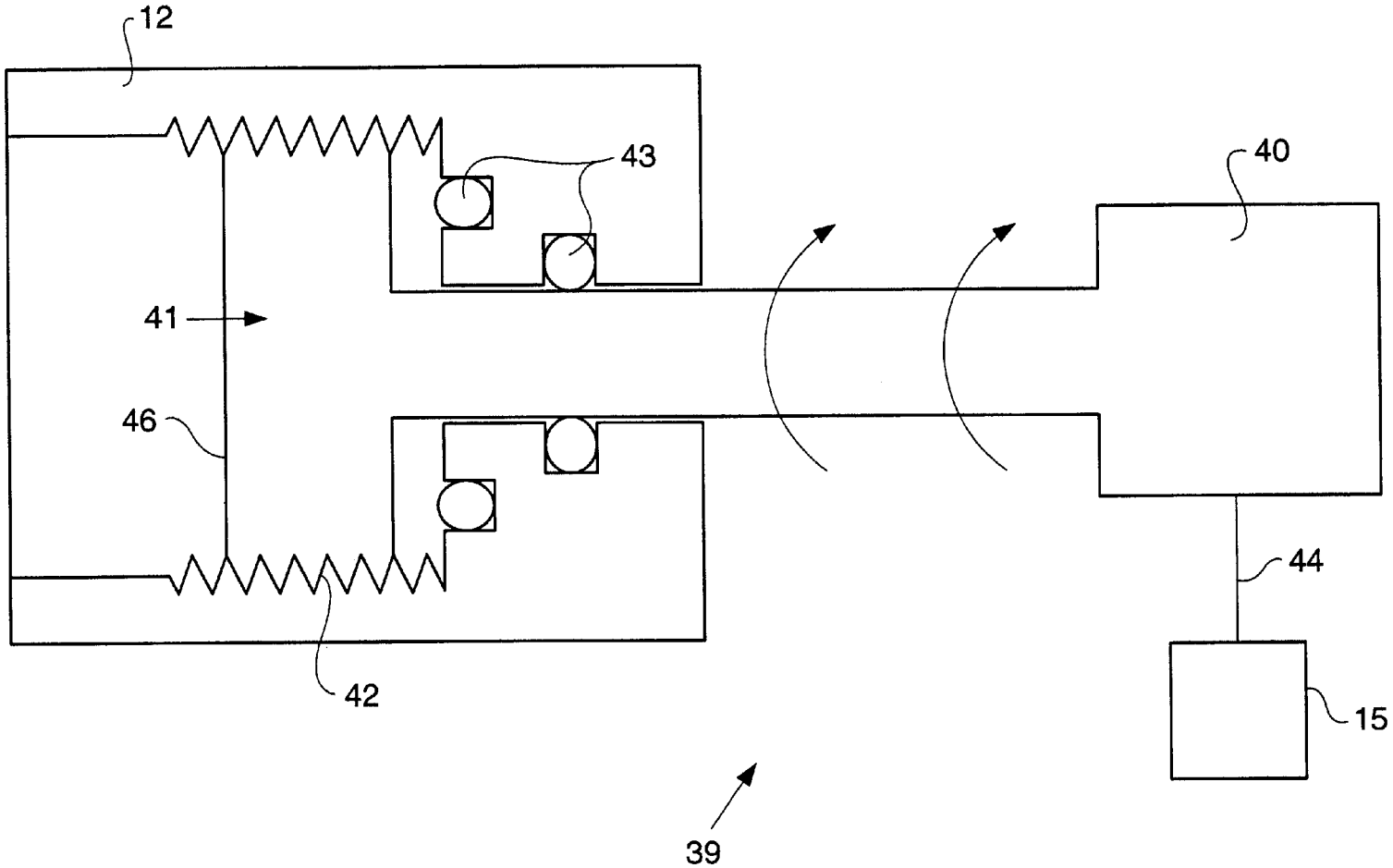
FIG. 2 is a side diagrammatic representation of one end of the common rail according to the preferred embodiment of the present invention.

Referring to FIG. 2, there is shown one end of the common rail 12 according to the preferred embodiment of the present invention. The volume reducer 39 includes a member 41 which has a threaded portion. Seals 43 are positioned between to the member 41 and the interior of common rail 12 to prevent fluid leakage from within the common rail 12. The member 41 protrudes through one end of the common rail 12 and is movable into and out of the common rail 12 in order to alter the fluid volume within the hydraulic system 10 by changing the effective volume of the common rail 12. Although it is preferable that the fluid volume of the hydraulic system 10 is reduced by advancing the member 41 into the common rail 12, those skilled in the art will appreciate that the advancing member 41 can be positioned at any point within the hydraulic system 10 in order to reduce the fluid volume. A reversible electric D.C. motor 40 is coupled to the member 41, at least in part, by positioning a screw linkage 42 between a pressure face portion 46 of the member 41 and the reversible electric D.C. motor 40. The fluid volume within the hydraulic system 10 is defined, at least in part, by the pressure face portion 46 of the member 41.

Prior to the engine 9 starting, the electronic control module 15 energizes the reversible electric D.C. motor 40 via the communication line 44 causing the reversible electric D.C. motor 40 to rotate in one direction. The rotation causes the member 41 to advance via its threaded engagements thereby reducing the fluid volume of the hydraulic system 10 and increasing the pressure in the hydraulic system 10 to a predetermined pressure. The predetermined pressure is preferably the pressure within the hydraulic system 10 required to activate the fuel injectors 13 and, thus, start the engine 9. However, upon the engine 9 starting, the fluid within the common rail 12 is delivered to the fuel injectors 13 via the device supply lines 29 requiring the fluid volume within the common rail 12 to further decrease in order to sustain fluid pressure until the pump 11 can take over. Thus, the member 41 will continue to advance along its threaded portion toward the opposite end of the common rail 12 in order to further decrease the effective volume of the common rail 12 and sustain the predetermined pressure within the hydraulic system 10. When pump 11 can sustain the predetermined pressure within the hydraulic system 10 without the aid of the volume reducer 39, the electronic control module 15 commands the reversible electric D.C. motor 40 via the communication line 44 to rotate in the opposite direction causing the member 41 to slowly retract to its initial position via its threaded portion. The member 41 should retract at a speed slow enough that the pump 11 can supply an adequate amount of pressurized fluid to satisfy the expanding volume of the common rail 12 and the consumption demands of the fuel injectors 13.

Figure 3:
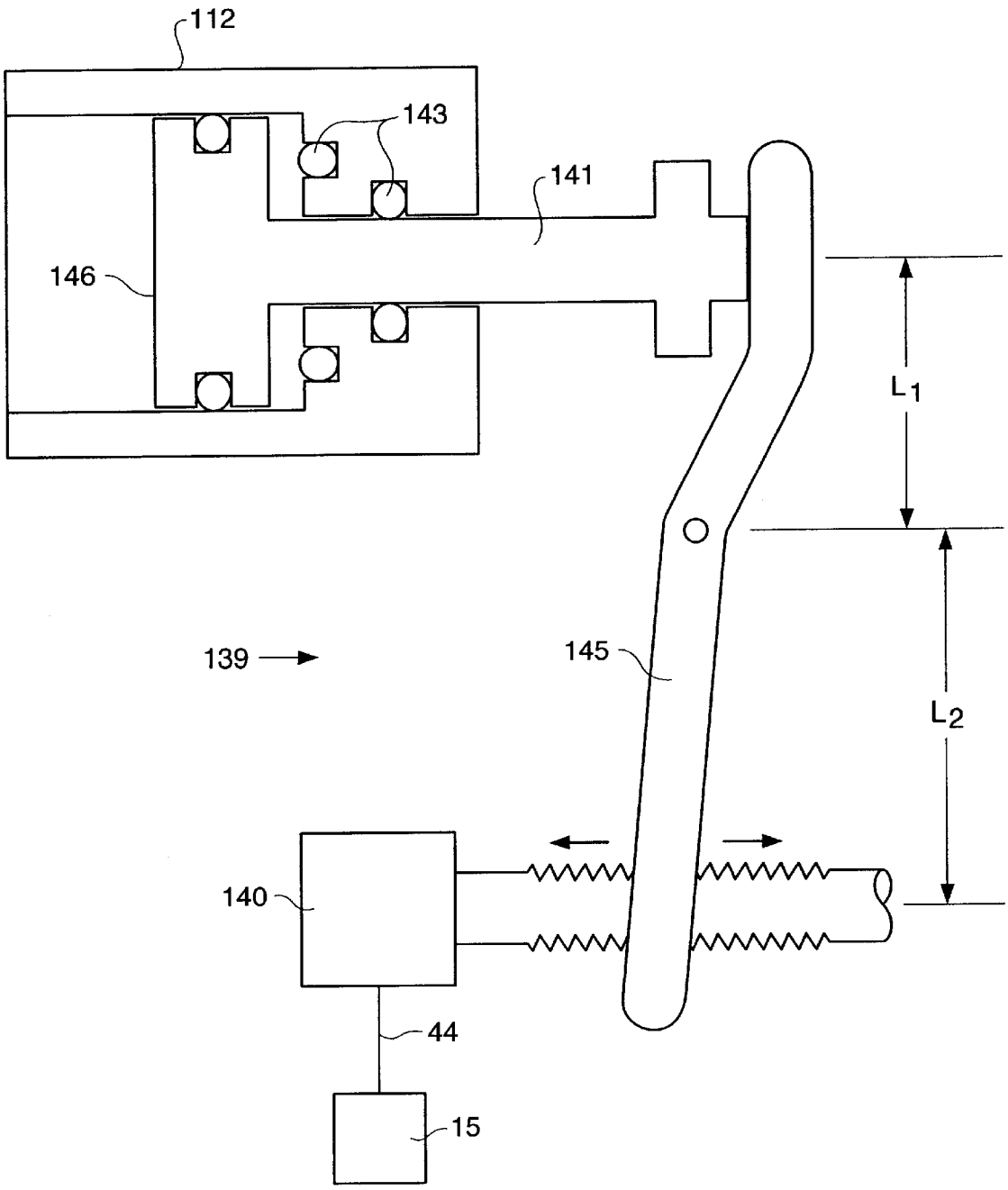
FIG. 3 is a side diagrammatic representation of one end of the common rail according to an alternative embodiment of the present invention.

Referring to FIG. 3, there is shown one end of the common rail 112 according to the alternate embodiment of the present invention. As in the preferred embodiment, the volume reducer 139 is preferably mounted to one end of the common rail 112, and seals 143 are positioned between the pressure face portion 146 of the member 141 and the interior of the common rail 112 in order to prevent fluid leakage. However, instead of the reversible electric D.C. motor 40 being coupled to the member 41 at least in part by the positioning of the screw linkage 42, the reversible electric D.C. motor 140 is coupled to the member 141 by positioning a lever 145 and a different screw linkage between the pressure face 146 of the member 141 and the reversible electric D.C. motor 140. The length 1 (L1) and length 2 (L2) of lever 145 are set so that the maximum travel of the member 141 is sufficient to sustain the predetermined pressure within the common rail 112 and the difference between length 1 and length 2 is sufficient to gain the mechanical advantage necessary for the reversible electric D.C. motor 140 to generate the relatively high pressures necessary to operate the fuel injectors 13.

Prior to the engine 9 starting, the electronic control module 15 energizes the reversible electric D.C. motor 140 via the communication line 144, causing the reversible electric D.C. motor 140 to advance the lever 145. In return, the lever 145 will advance the member 141 towards the opposite end of the common rail 112, reducing the effective volume of the common rail 112 and increasing the pressure within the hydraulic system 10 to a predetermined pressure. In order to start and continue running engine 9, the fluid within the common rail 112 is delivered to the fuel injectors 13 via the device supply lines 29, causing the pressure within the common rail 112 to decrease. This pressure drop should be countered by the volume reducer 139 and/or the pump 11 in order to sustain the fluid pressure necessary to keep the engine 9 running. Thus, the member 141 will continue to advance along its threaded portion toward the opposite end of the common rail 112 in order to further decrease the effective volume of the common rail 112 and sustain the predetermined pressure within the hydraulic system 10. When pump 11 can sustain the predetermined pressure within the hydraulic system 10 without the aid of the volume reducer 139, the electronic control module 15 commands the reversible electric D.C. motor 140 via the communication line 144 to rotate in the opposite direction causing the lever 145 and the member 141 to retract to their initial positions at a speed slow enough that the pump 11 can sustain supply pressurized fluid to the expanding volume of the common rail 112. Although the reversible electric D.C. motor 40, 140 is preferably used as the means to advance the member 41, 141 into the common rail 12, 112 in both embodiments of the present invention, those skilled in the art will appreciate that other means of advancing the member 41, 141 into and out of the common rail 12, 112 are contemplated, including but not limited to, biasing springs, a solenoid, or possibly a piezo actuator, any of which could be coupled to the member 41, 141 via a force amplifying lever.

Returning to FIG. 1, in order to control the pressure within the hydraulic system 10, there should be a means for estimating the pressure within the common rail 12. Preferably, accurate control of fluid pressure is achieved by a closed-loop feedback control system coded into the electronic control module 15 in a conventional manner. The electronic control module 15 is in communication with a pressure sensor 21 via a sensor communication line 22. The pressure sensor 21 detects the pressure of the fluid being supplied to the fuel injectors 13. The pressure sensor 21 is preferably positioned in the common rail 12 and periodically samples the actual pressure within the hydraulic system 10. Preferably, the frequency of sampling is selected in order to detect a mean or average pressure that is not too sensitive to insignificant transient effects. The pressure sensor 21 communicates the pressure within the hydraulic system 10 to the electronic control module 15 via the sensor communication line 22. The electronic control module 15 compares the actual fluid pressure with the desired or predetermined pressure, which is preferably the pressure within the hydraulic system 10 required to activate the fuel injectors 13 and, thus, start the engine 9. If the actual pressure within the hydraulic system 10 needs to be increased in order to reach or sustain the predetermined pressure, the electronic control module 15 commands the reversible electric D.C. motor 40 to rotate in one direction causing the member 41 to advance along its threaded portion towards the opposite end of the common rail 12. If the actual pressure within the hydraulic system 10 can be sustained at the predetermined pressure without the aid of the volume reducer 39, the electronic control module 15 commands the reversible electric D.C. motor 46 to rotate in the opposite direction causing the member 41 to retract to its initial position at a speed slow enough for the pump 11 to pressurize the expanding fluid volume within the common rail 12. Alternatively, an open-loop feedback circuit may be used to control the pressure within the hydraulic system 10. In an open-loop feedback circuit, a reversible electric D.C. motor 40 which is coupled to the volume reducer 39 is engineered so that its maximum torque causes the advancement of the member 41 required to achieve the predetermined pressure. The reversible electric D.C. motor 40 could then automatically reverse after a predetermined time period, preferably corresponding to a time it takes for pump 11 to pressurize the hydraulic system 10 without the help from the volume reducer 39.

Although in the illustrated example the volume reducer 39 is included in order to reduce crank time during the start up of the engine 9 by preferably pressurizing the hydraulic system 10, those skilled in the art appreciate that the volume reducer 39 could also supplement a pump priming reservoir or any other means used to accelerate pressurization of the hydraulic system 10 at start up.

INDUSTRIAL APPLICABILITY

Figure 4:
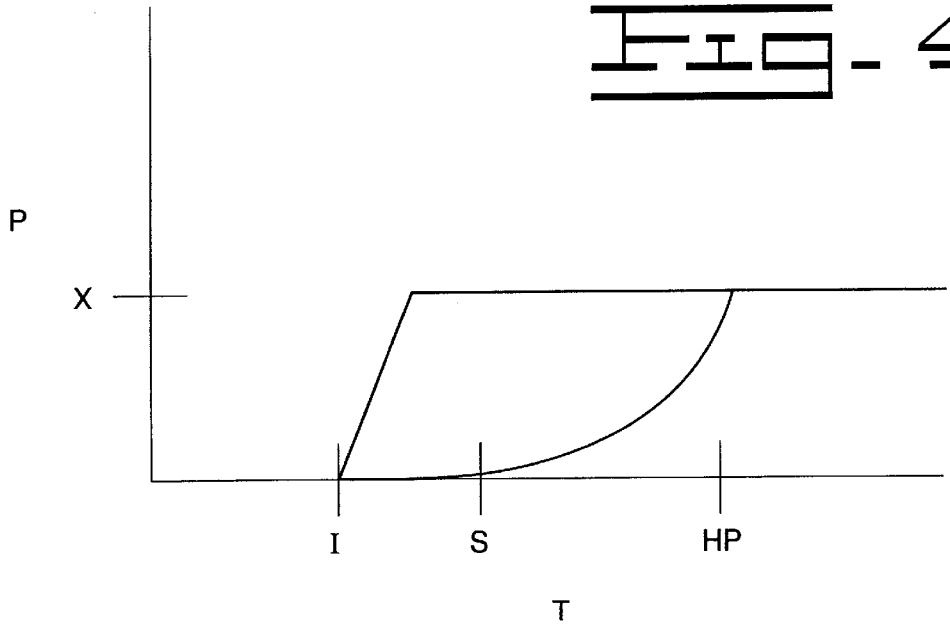
FIG. 4 is a graph of pressure within the common rail and pressure at the pump outlet versus time during engine start-up according to the present invention.
Figure 5:
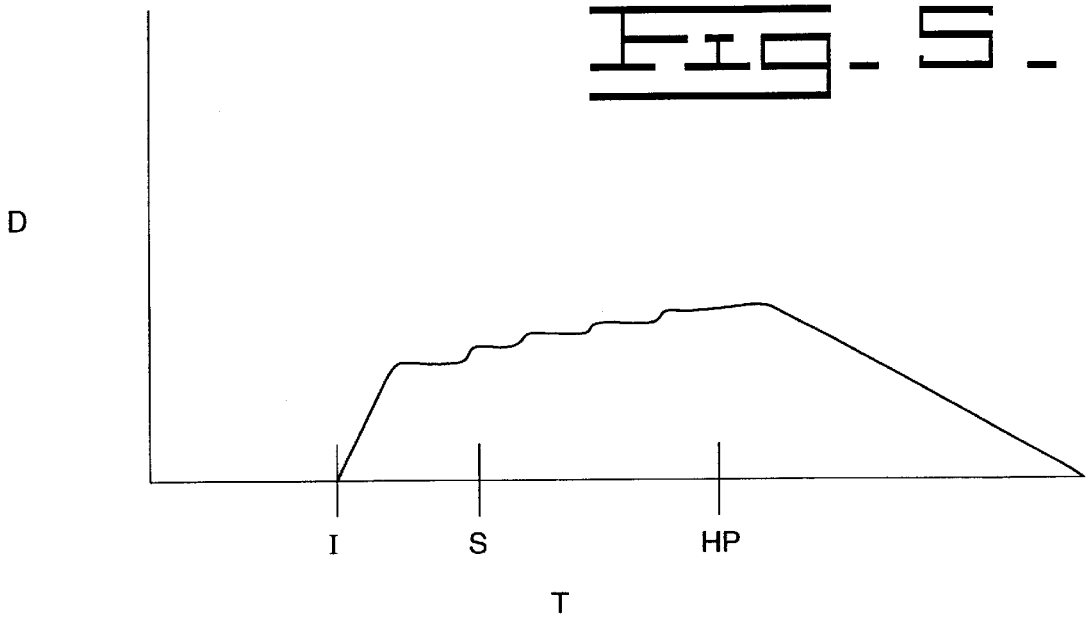
FIG. 5 is a graph illustrating the member displacement within the common rail versus time during the same engine start-up of FIG. 4 according to the present invention.

Referring to FIG. 4 and FIG. 5, there are shown two graphs. FIG. 4 illustrates the pressure (P) within the common rail 12 and pressure at the pump outlet versus time according to the present invention, and FIG. 5 illustrates the member displacement (D) within the common rail 12 caused by the advancing member 41 versus time during the same start-up as FIG. 4 according to the present invention. Prior to activating the ignition (I), the pressure (P) within the common rail 12 is negligible (equivalent to the ambient pressure). The member 41 of the volume reducer 39 is at its initial position and, thus, there is no member displacement (D) within the common rail 12. At the time the ignition (I) is activated, the electronic control module 15 energizes the reversible electric D.C. motor 40 that is coupled to the member 41 via the screw linkage 42. The rotation of the reversible electric D.C. motor 40 advances the member 41 along its threaded portion toward the opposite end of the common rail 12, increasing member displacement (D). The member displacement (D) causes the pressure within the common rail 12 to quickly increase to the predetermined pressure (x) within the hydraulic system 10. So to avoid any delay in the crank time, the pressure within the hydraulic system 10 preferably reaches the predetermined pressure (x) before the engine 9 begins to start. After the predetermined pressure. (x) has been reached, the member 41 will remain steady in its position for a short period prior to the engine 9 starting so that the predetermined pressure (x) can be sustained. However, once the engine 9 starts, the fuel injectors 13 are using the fluid that is delivered from the common rail 12 via the device supply passages 29, causing the pressure within the common rail 12 to decrease. Thus, in order to sustain pressure within the hydraulic system 10 at the predetermined pressure (x), the member 41 further advances along its threaded portion, increasing member displacement (D) and reducing the effective volume of the common rail 12. As the pump 11 begins to pressurize the hydraulic system 10 as shown by the line labeled "HP", the rate of increase in member displacement (D) will level off. Preferably, the pressure sensor 21 will sense that the predetermined pressure has been sustained for a substantial period of time without further advancement of the member 41 and communicate this to the electronic control module 15 via the sensor communication line 22. The electronic control module 15 will signal the reversible electric D.C. motor 40 to rotate in the opposite direction, causing the member 41 to retract along its threaded portion at a speed slow enough that the pump 11 can sustain the predetermined pressure (x) within the expanding volume of the common rail 12. When the pump 11, alone, is sustaining the predetermined pressure (x) within the hydraulic system 10, the member 41 is back at its initial position where there is no member displacement (D).

Referring to FIGS. 1 and 2, when the engine 9 is dormant for a substantial time period, the pressure within the hydraulic system 10 will eventually decay into equilibrium with the ambient pressure. Further, in cold temperatures, the hydraulic fluid, i.e., oil, may contract leaving pockets of space within the hydraulic system 10. When the ignition is activated, the engine 9 begins its initiation procedure to set all the various parameters and then actually start the engine 9. During the initiation period, the pump 11 begins to pressurize the fluid within the hydraulic system 10. However, the operator of the vehicle or work machine may become annoyed when the pump 11 takes more time to pump pressurized fuel throughout the hydraulic system 10 than the rest of the initiation process, causing delay in the starting of the engine 9. In order to reduce the crank time during the start up of engine 9, the volume reducer 39 pressurizes the fluid within the hydraulic system 10 until the pump 11 can sustain the pressure of the hydraulic system 10 at the pressure required to activate the fuel injectors and keep the engine 9 running. Although in both embodiments of the present invention the volume reducer 39 consists of the member 41 coupled to the reversible electric D.C. motor 40, those skilled in the art will appreciate that other mechanisms could be used to reduce the volume within the common rail 12, including, but not limited to, the possibility of an advancing rod positioned in the common rail 12 coupled to an operator-controlled mechanism.

Upon activating the ignition, the electronic control module 15 activates the pump 11 via the pump communication line 18 and energizes the reversible electric D.C. motor 40 via the communication line 44. Although, upon activation of the ignition, the pump 11 begins to pressurize fluid delivered from the low pressure reservoir 14 via the low pressure supply line 20, the pump 11 typically is unable to pressurize the fluid and begin delivering it to the common rail 12 via the high pressure supply line 37 until after the engine 9 has been cranking for a period of time.

The member 41 of the volume reducer 39 is coupled to the reversible electric D.C. motor 40 via a screw linkage 42 positioned between the pressure face portion 46 of the member 41 and the reversible electric D.C. motor 40. When the electronic control module 15 energizes the reversible electric D.C. motor 40, the reversible electric D.C. motor 40 rotates in one direction causing the member 41 to advance along its threaded portion toward the opposite end of the common rail 12 and thereby reduce the effective volume of the common rail 12 and the fluid volume of the hydraulic system 10. The fluid volume defined in part by the pressure face portion 46 of the member 41 is preferably reduced to the point where the actual pressure within the hydraulic system 10 reaches the predetermined pressure at which the fuel injectors 13 can be activated. The fuel injectors 13 can then pressurize the fuel for delivery to their respective combustion chambers to start engine 9.

Even after the engine 9 starts, the pump 11 typically is still not able to pressurize the fluid within the hydraulic system 10 to the predetermined pressure (x). (shown in FIGS. 4 and 5). Moreover, after the engine 9 starts, the fluid within the common rail 12 is delivered to the fuel injectors 13 via the device supply lines 29 causing the pressure within the common rail 12 to decrease. So, the readings of the pressure sensor 21 within the common rail 12 will typically still show that the actual pressure within the hydraulic system 10 needs to be increased in order sustain the predetermined pressure (x). The pressure sensor 21 communicates the actual pressure within the hydraulic system 10 to the electronic control module 15 via the sensor communication line 22. The electronic control module 15 compares the actual pressure with the predetermined pressure (x) and determines that the member 41 needs to be advanced further into the common rail 12 in order to sustain the predetermined pressure. The electronic control module 15 energizes the reversible electric D.C. motor 40 via the communication line 44. The member 41 coupled to the reversible electric D.C. motor 40 advances further along its threaded portion towards the opposite end of the common rail 12 and thereby further reduces the effective volume of the common rail 12 to compensate for the fluid consumed by the fuel injectors 13. The further advancement of the member 41 into the common rail 12 sustains the predetermined pressure (x) within the hydraulic system 10. Thus, the fuel injectors 13 continue to inject the fuel. The pressure sensor 21 continues to monitor the pressure within the hydraulic system 10 and communicate the actual pressure to the electronic control module 15 where it is compared with the predetermined pressure (x). As long as the pressure sensor 21 senses that the predetermined pressure within the hydraulic system 10 cannot be sustained without the volume reducer 39, the electronic control module 15 will continue to energize the reversible electric D.C. motor 40 so that the member 41 will advance further into the common rail 12.

At some point, the pressure sensor 21 communicates to the electronic control module 15 an actual pressure within the hydraulic system 10 that is sufficient to keep the engine 9 running without the aid of the volume reducer 39. Those skilled in the art appreciate that there are different strategies for controlling how the pressure sensor 21 and the electronic control module 15 will determine that the volume reducer 39 is no longer needed to pressurize the hydraulic system 10. For instance, the electronic control module 15 can be configured so that it will continue to energize the reversible electric motor 40 until the predetermined pressure within the hydraulic system 10 has been sustained for a time period sufficient for the pump 11 to pressurize the hydraulic system 10. When the electronic control module 15 determines that the pump 11 can sufficiently pressurize the hydraulic system 10, the electronic control module 15 signals the reversible electric D.C. motor 40 via the communication line 44 to rotate in the opposite direction. The member 41 which is coupled to the reversible electric D.C. motor 40 via the screw linkage 42 retracts back along its threaded portion to its initial position at a rate slow enough that the pump 11 can sustain the predetermined pressure within the expanding fluid volume of the common rail 12 and while fluid continues to be consumed by the fuel injectors 13. The pump 11 will then be the only source of pressure for the hydraulic fluid within the hydraulic system 10. The fluid within the common rail 12 continues to be delivered to the plurality of device inlets 35 of the fuel injectors 13 via the plurality of device supply lines 29. After the fluid is used by the fuel injectors 13, it is channeled back to the low pressure reservoir 14 via the oil return line 25 for reuse within the hydraulic system 10.

The volume reducer's function is not solely to make up for thermal contraction of the actuating fluid. It also has the ability to partially compensate for any other losses from the common rail through other parts of the system. For example, if the actuating fluid were to "leak" from the common rail to the cylinder head due to injectors with clearances that are at the high end of tolerance, the volume reducer would be able to compensate for this phenomenon since these higher clearances are only an issue during startup.

Although the hydraulic system described is a fuel injection system using oil as its hydraulic medium, those skilled in the art will appreciate that other hydraulic systems are contemplated, including but not limited to intake and/or exhaust valve actuators, engine brake actuators that might share a common rail with the fuel injectors 13. Although the invention is illustrated using a reversible electric D.C. motor 40, other devices could be used, including but not limited to solenoids, or possible stored energy devices such as springs, etc. that are reset before each start up. Although a lever is described as a means of generating a force multiplier, other means are contemplated, including but not limited to appropriate gear ratios, etc.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A method of pressurizing a hydraulic system for an engine, comprising the steps of:

reducing a fluid volume of the hydraulic system until fluid pressure reaches a predetermined pressure;

starting the engine;

sustaining pressure in the hydraulic system at least in part by further reducing the fluid volume of the hydraulic system.

2. The method of claim 1 wherein the step of reducing the fluid volume of the hydraulic system until fluid pressure reaches the predetermined pressure includes a step of advancing a member into a common rail portion of the hydraulic system.

3. The method of claim 2 wherein the step of advancing includes a step of energizing an electric motor.

4. The method of claim 3 wherein the step of advancing includes a step of coupling the member to the electric motor.

5. The method of claim 4 wherein the step of coupling includes a step of positioning a screw linkage between a pressure face of the member and the electric motor.

6. The method of claim 2 wherein the step of advancing includes a step of moving the member from one end of the common rail toward an opposite end of the common rail.

7. The method of claim 6 wherein the step of moving includes a step of energizing the electric motor.

8. The method of claim 1 including a step of expanding the fluid volume of the hydraulic system after a pump of the hydraulic system pressurizes the fluid volume to the predetermined pressure.

9. A method of reducing crank time during engine startup for an engine with a hydraulic system, comprising steps of:

pressurizing fluid in the hydraulic system at least in part by reducing a fluid volume of the hydraulic system;

the step of pressurizing includes a step of advancing a member into a common rail portion of the hydraulic system;

the step of advancing includes a step of energizing an electric motor;

the step of energizing the electric motor includes a step of coupling the member to the electric motor; and the step of coupling includes a step of positioning a screw linkage between a pressure face of the member and the electric motor.

10. The method of claim 9 wherein the step of advancing includes a step of moving the member from one end of the common rail toward an opposite end.

11. A hydraulic system for an engine comprising:

a common rail with an inlet and at least one outlet;

a pump with an outlet fluidly connected to the inlet of the common rail;

at least one hydraulic device with an inlet fluidly connected to the outlet of the common rail;

a volume reducer including a member movable into and out of the common rail, and an electric motor coupled to the member; and wherein the electric motor is coupled at least in part via a screw linkage.

12. The volume reducer of claim 11 wherein the member has a threaded portion.

13. A hydraulic system for an engine comprising:

common rail with an inlet and at least one outlet;

a pump with an outlet fluidly connected to the inlet of the common rail;

at least one hydraulic device with an inlet fluidly connected to the outlet of the common rail;

a volume reducer including a member movable into and out of the common rail via an electric motor coupled to the member; and wherein the member protrudes through one end of the common rail and is movable away from the one end toward an opposite end.

14. The hydraulic system of claim 13 wherein a pressure face portion of the member defines a portion of the fluid volume of the hydraulic system.

15. The method of claim 1 wherein the starting step includes a step of hydraulically actuating a fuel injector.

16. The method of claim 15 wherein the starting step includes a step of supplying pressurized oil to the fuel injector.

17. The method of claim 1 including a step of controlling the reducing and sustaining steps with an electronic control module.

18. The method of claim 1 wherein said predetermined pressure is a pressure sufficient to operate a fuel injector.

19. The hydraulic system of claim 11 wherein the common rail is at least partially located in an engine head.

20. The hydraulic system of claim 11 wherein the at least one hydraulic device includes a fuel injector.

21. The hydraulic system of claim 20 wherein the fuel injector is a hydraulically actuated fuel injector.

* * * * *